US010971846B2

(12) United States Patent
So et al.

(10) Patent No.: US 10,971,846 B2
(45) Date of Patent: Apr. 6, 2021

(54) BOARD TO BOARD CONNECTOR

(71) Applicant: MPD Corp., Incheon (KR)

(72) Inventors: Hyun-Hwa So, Incheon (KR); Hyun-Cheul Na, Gyeonggi-do (KR)

(73) Assignee: MPD Corp., Incheon (KR)

( * ) Notice: Subject to any disclaimer, the term of this patent is extended or adjusted under 35 U.S.C. 154(b) by 0 days.

(21) Appl. No.: 16/555,968

(22) Filed: Aug. 29, 2019

(65) Prior Publication Data

US 2021/0028570 A1 Jan. 28, 2021

(30) Foreign Application Priority Data

Jul. 25, 2019 (KR) ..... 10-2019-0090159
Aug. 8, 2019 (KR) ..... 10-2019-0096876

(51) Int. Cl.

| | |
|---|---|
| ***H01R 13/24*** | (2006.01) |
| ***H01R 12/71*** | (2011.01) |
| ***H01R 13/18*** | (2006.01) |
| ***H01R 12/52*** | (2011.01) |
| ***H01R 13/17*** | (2006.01) |

(52) U.S. Cl.

CPC ..... *H01R 13/2457* (2013.01); *H01R 12/52* (2013.01); *H01R 12/716* (2013.01); *H01R 13/17* (2013.01); *H01R 13/18* (2013.01); *H01R 13/2442* (2013.01)

(58) Field of Classification Search

CPC .... H01R 13/2442; H01R 13/15; H01R 13/20; H01R 13/2457; H01R 13/17; H01R 12/716; H01R 12/714; H01R 12/73

See application file for complete search history.

(56) References Cited

U.S. PATENT DOCUMENTS 6,231,352 B1 * 5/2001 Gonzales ..... H01R 12/52 439/66
6,572,386 B1 * 6/2003 Howell ..... H01R 13/2428 439/66

(Continued)

FOREIGN PATENT DOCUMENTS

KR 10-2018-0072691 A 6/2018
KR 10-1922142 B1 11/2018

OTHER PUBLICATIONS

Office Action issued by the Korean Intellectual Property Office dated Jul. 17, 2020.

*Primary Examiner* — Briggitte R. Hammond
(74) *Attorney, Agent, or Firm* — IP & T Group LLP

(57) ABSTRACT

A board to board connector may include: a support including: a circumference part having an internal space of which a top and a bottom are open; one or more first protruding parts protruding outward from the top of the circumference part in an obliquely upward direction; and one or more first fixing parts protruding from the bottom of the circumference part; a terminal including: a body having an internal space of which a top and a bottom are open; a second protruding part protruding from the top of the body in an obliquely upward direction; and one or more second fixing parts protruding from the bottom of the body, and disposed on the inside of the circumference part of the support; and an insulating part formed between an inner circumferential surface of the circumference part of the support and an outer circumferential surface of the body of the terminal.

10 Claims, 21 Drawing Sheets

(56) References Cited

U.S. PATENT DOCUMENTS

| | | | | |
|---|---|---|---|---|
| 6,899,568 | B2 * | 5/2005 | Caines | H01R 13/2407 439/66 |
| 7,857,632 | B2 * | 12/2010 | Liu | H01R 13/2492 439/66 |
| 10,431,912 | B2 * | 10/2019 | Murtagian | H01R 13/2442 |
| 10,483,695 | B2 * | 11/2019 | Cheng | H01R 13/2442 |
| 2015/0111400 | A1 * | 4/2015 | Hashiguchi | H01R 12/714 439/66 |
| 2017/0110822 | A1 * | 4/2017 | Kuwabara | H05K 7/1407 |
| 2019/0052021 | A1 * | 2/2019 | Hsu | H01R 13/6471 |
| 2019/0190207 | A1 * | 6/2019 | Ju | H01R 33/74 |

* cited by examiner

BOARD TO BOARD CONNECTOR

CROSS REFERENCE

The present application incorporates Korean Patent Application No. 10-2018-0042828 filed on Apr. 12, 2018, Korean Patent Application No. 10-2019-0090159 filed on Jul. 25, 2019, and Korean Patent Application No. 10-2019-0096876 filed on Aug. 8, 2019, for reference in its entirety.

BACKGROUND

1. Technical Field

The present disclosure relates to a board to board connector. Furthermore, the present disclosure relates to a board to board connector which has a compact structure in which a terminal and a support are formed as one body through an insulating part by injection molding, and which is fixedly connected to a first board and connected to a second board in a contact manner.

2. Related Art

In general, electric parts are attached on a circuit board and connected to each other to form a circuit. This circuit board is variously used for various electronic devices such as a computer, TV, etc. With the development of information communication industry, the technology based on a circuit board has rapidly grown, and the importance of the technology is increasing day by day.

In particular, a printed circuit board (PCB) is a thin board on which electric parts such as an integrated circuit, a resistor, a switch, etc. are soldered. And it can be used for all kinds of electronic products. The PCB can stabilize the characteristics of circuits and implement mass production.

In order to electrically connect such boards to each other, a connector is required. 'Connector' refers to an electronic part for electrically connecting power to a device, electrically connecting a device to a device, and electrically connecting unit parts to each other within a device. Such a connector may couple objects to transfer an electrical signal and a ground voltage between the objects. For example, the connector may be used for coupling between PCBs, coupling between a PCB and a coaxial cable, coupling between coaxial cables, etc.

Thus, it is very important to properly and accurately position connectors between boards or electronic parts. When the positions of the connectors are slightly different between the boards or electronic parts, alignment may be distorted to cause an error in electrical connection between the boards or the electrical parts. That is, a contact pin in the connector for electrical connection needs to be brought in contact with a contact surface as much as possible, in order to minimize electrical noise.

In particular, when a plurality of connectors are coupled between PCBs, a distance between the positions of the two PCBs, to which one connector is to be coupled, needs to be equal to a distance between the positions of the two PCBs, to which another connector is to be coupled, in order to electrically and accurately connect the connectors. Furthermore, when the connectors are misaligned with each other and connected to electronic parts, the connectors and/or the electronic parts may be substantially damaged.

When a circuit board and a connector are brought in surface contact with each other, all surfaces may not be reliably adhered to each other, and the adhesion between the circuit board and the connector may be degraded. As a result, a defect may occur in electrical connection between circuit boards which are to be connected to each other.

Generally, according to the related art illustrated in FIG. 1, different boards are electrically connected through a cylinder-type compression coil spring pin. A connector using such a pin has a structure in which a coil spring, a steel ball and the like are embedded in a cylinder. Since the structure is complex, it takes quite a long time to assemble the structure. Furthermore, when such a connector is used for a long term, the elasticity and restoring force of the spring may be degraded to reduce adhesion between the boards and the connector. When the boards arranged in the top-to-bottom direction are not aligned in parallel to each other, the contact between the upper board and the pin may be destabilized.

SUMMARY

The present disclosure has been proposed to solve the above problems, various embodiments are directed to a board to board connector which has a compact structure in which a terminal and a support are formed as one body through an insulating part by injection molding and manufactured as a complete product. Therefore, the present disclosure does not require an assembling process of parts and can implement a manufacturing process capable of manufacturing products having the same specification, thereby improving the stability of product quality.

Also, various embodiments are directed to a board to board connector which has a plurality of protruding parts formed on one circumference thereof and protruding in an outward direction in order to raise adhesion between the connector and a second board at the top, even though distances between a first board at the bottom, to which the connector is coupled, and the second board are not equal to each other, when the connector is fixed to the first board and the second board is disposed over the connector.

In an embodiment, a board to board connector which couples a first board and a second board to each other may include: a support including: a circumference part having an internal space of which a top and a bottom are open; one or more first protruding parts protruding outward from the top of the circumference part in an obliquely upward direction; and one or more first fixing parts protruding from the bottom of the circumference part; a terminal including: a body having an internal space of which a top and a bottom are open; a second protruding part protruding from the top of the body in an obliquely upward direction; and one or more second fixing parts protruding from the bottom of the body, and disposed on the inside of the circumference part of the support; and an insulating part formed between an inner circumferential surface of the circumference part of the support and an outer circumferential surface of the body of the terminal.

The first protruding part of the support and the second protruding part of the terminal may have an elastic force.

The insulating part may be formed of resin.

One or more stoppers may protrude from the top surface of the insulating part, and the stopper may have a height set in a range between the height of the top of the circumference part of the support and the height of the first protruding part of the support.

The circumference part of the support may have one or more cutouts formed at the bottom thereof, and the insulating part may additionally include an outer insulating part disposed on the outside of the circumference part of the support.

The inner insulating part disposed on the inside of the circumference part of the support may have one or more air flow paths whose tops and bottoms are open.

An end portion of the first protruding part of the support and an end portion of the second protruding part of the terminal may be horizontally bent, respectively.

The first protruding part may have a first protrusion formed on the end portion thereof, and the second protruding part may have a second protrusion formed on the end portion thereof.

The body of the terminal may be formed in a rectangular shape.

The board to board connector may further include an O-ring disposed on the outer circumference of the first protruding part of the support at the top of the outer insulating part.

The support may include the plurality of first protruding parts and a plurality of RF (Radio Frequency) signal leakage prevention members protruding vertically between the respective first protruding parts.

In an embodiment, a board to board connector which couples different boards may include: a shell of which a first side is completely open and a second side is partially open; an insulating part formed of an insulating material, and embedded in the shell; a support including: one or more first protruding parts coupled to the shell so as to partially close the first side and protruding from a body in one direction; and one or more second protruding parts protruding from the body in another direction, and coupled to the shell through the first protruding parts, wherein the second protruding parts are formed across one circumference so as to protrude from the outside of the body in the another direction; and a terminal configured to electrically connect the different boards using a first side part of a connection member extended to the outside through a hole formed on one side of the shell and a second side part of the connection member extended to the outside through a hole formed on the other side of the shell.

The second protruding parts of the support may be bent at least twice and protrude in the other direction.

The second protruding parts of the support may protrude from the top of the body toward the outside.

The first side part of the connection member and the second protruding part of the support may be elongated to face the same direction.

The number of the first protruding parts included in the support may be equal to the number of the second protruding parts included in the support, and the first protruding parts and the second protruding parts may alternately protrude from the outside of the body.

The first side part of the connection member of the terminal may be bent at least twice and elongated in one direction.

The terminal has a hollow rectangular-shaped fixing member, and the connection member may be attached and fixed to one side of the inside of the fixing member.

The fixing member may have protrusions formed on at least both sides of the outer surface thereof and having a predetermined slope.

The support and the terminal may be formed of beryllium.

The insulating part may be formed of PTEE (Poly Tetra Fluoro Ethylene).

The second protruding part of the support and the first side part of the connection member may have protrusions formed thereon.

DETAILED DESCRIPTION

Figure 1:
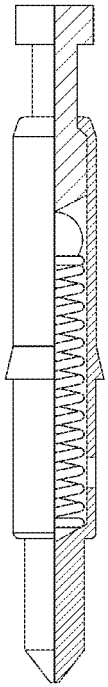
FIG. 1 (Related Art)
FIG. 1 is a diagram illustrating the related art.

The above-described purposes, features and advantages of the present disclosure will be more clarified through the following embodiments with reference to the accompanying drawings.

The descriptions of specific structures or functions are made only to describe embodiments according to the concept of the present disclosure. The embodiments according to the concept of the present disclosure may be carried out in various manners, and it should not be interpreted that the embodiments are limited to the embodiments described in this specification or application.

Since the embodiments according to the concept of the present disclosure can be modified in various manners and have various forms, specific embodiments will be illustrated in the drawings and described in detail in this specification or application. However, the specific embodiments are not limited to the embodiments according to the concept of the present disclosure, but it should be understood that the embodiments include all modifications, equivalents and substitutions without departing from the scope and technical range of the present disclosure.

The terms such as first and/or second may be used for describing various components, but the components are not limited by the terms. The terms may be used only to distinguish one element from another element. For example, a first element may be referred to as a second element, and the second element may also be referred to as the first element, without departing from the scope according to the concept of the present disclosure.

When an element is referred to as being "coupled" or "connected" to another element, it may not only indicate that the former element is directly coupled or connected to the latter element, but also indicate that another element may be present between the former and latter elements. On the other hand, when an element is referred to as being "directly coupled" or "directly connected" to another element, it may indicate that no element is present therebetween. Other expressions for describing the relation between elements, such as "between", "immediately between", "adjacent to", and "directly adjacent to" should be analyzed in the same manner.

The terms used in this specification are used only to describe a specific embodiment, and do not limit the present disclosure. The terms of a singular form may include plural forms unless referred to the contrary. In this specification, the meaning of "include" or "have" specifies a property, a number, a step, a process, an element, a component, or combinations thereof, but does not exclude one or more other properties, numbers, steps, processes, elements, components, or combinations thereof.

All terms used herein may have the same meanings as those understood by those skilled in the art to which the present disclosure pertains, as long as the terms are differently defined. The terms defined in a generally used dictionary should be analyzed to have meanings which coincide with contextual meanings in the related art. As long as the terms are not clearly defined in this specification, the terms may not be analyzed as ideal or excessively formal meanings.

Hereinafter, exemplary embodiments of the present disclosure will be described in detail with reference to the accompanying drawings. Like reference numerals in the drawings represent the same members.

The structure of a board to board connector in accordance with an embodiment of the disclosure will be described with reference to FIGS. 2 to 8B. The state in which two boards are electrically connected to each other by pressing a second board disposed over the board to board connector toward the board to board connector with the board to board connector fixed to a first board disposed thereunder will be described with reference to FIGS. 9A and 9B.

The board to board connector 1000 in accordance with the embodiment of the disclosure serves to electrically connect two boards, and includes a support 100, a terminal 200 and an insulating part 300.

The support 100 serves to fix the connector 1000 to a first board P1, and detachably support a second board P2.

When the first board P1 and the second board P2 are connected through the board to board connector 1000 in accordance with the embodiment of the present disclosure, the first board P1 may be disposed under the connector 1000, and the second board P2 may be disposed over the connector 1000. However, the first board P1 may be disposed over the connector 1000 and the second board P2 may be disposed under the connector 1000, while first and second protruding parts 120 and 220 of the connector 1000 are positioned to face downward and first and second fixing parts 130 and 230 of the connector 1000 are positioned to face upward. Furthermore, the connector 1000 may be disposed between the first and second boards P1 and P2 disposed in parallel to each other in a vertical direction.

Figure 7A:
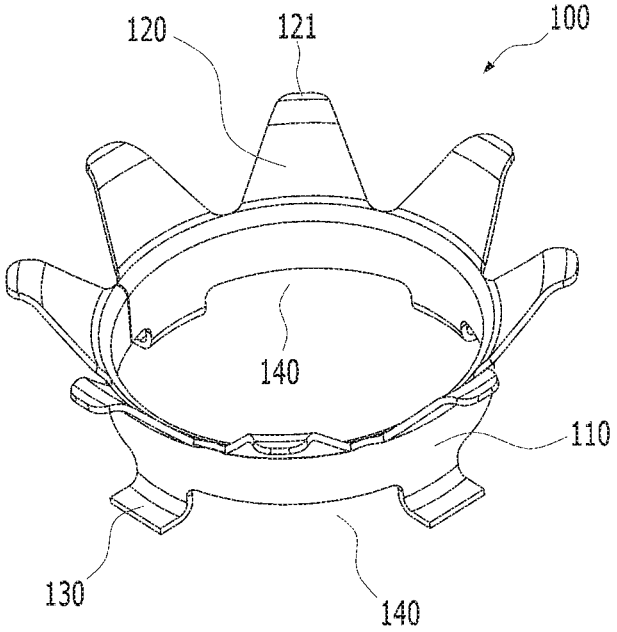
FIG. 7A is a perspective view illustrating a support of the board to board connector of FIG. 2.

As illustrated in FIG. 7A, the support 100 may include a circumference part 110 and one or more first protruding parts 120. The circumference part 110 may have an internal space of which a top and a bottom are open, and the one or more first protruding parts 120 may protrude outward from the top of the circumference part 110 in an obliquely upward direction. Since the first protruding parts 120 support the second board P2 in a contact manner, it is desirable that three or more first protruding parts 120 are formed to stably support the second board P2. However, the second board P2 may be supported by only one first protruding part 120 in a contact manner. Each of the first protruding parts 120 may have an inflection point (not illustrated) at which the slope thereof changes in the middle area. The support 100 may have the one or more first fixing parts 130 protruding from the bottom of the circumference part 110. The support 100 may be made of a metallic material. For example, the support 100 may be made of beryllium, KS-D-5102 C1720 or another metallic material. The material of the support 100 is not limited to such metallic materials, but the support 100 may be made of a different material having a predetermined stiffness. The first fixing part 130 is fixedly mounted on the first board P1. For example, the first fixing part 130 of the support 100 may be coupled to the surface of the first board P1 such as a PCB through soldering by an SMD (Surface Mount Device). However, the present embodiment is not limited thereto, but the first fixing part 130 may be inserted and fixed to the first board P1. When the first fixing part 130 of the support 100 is coupled to the first board P1 through soldering, the first fixing part 130 may horizontally protrude from the bottom of the circumference part 110 of the support 100 to the outside.

The second board P2 may be disposed on the first protruding parts 120 protruding from the top of the circumference part 110 of the support 100. The first protruding parts 120 of the support 100 may have a predetermined elastic force to stably support the second board P2 even when the second board P2 is not aligned parallel to the first board P1.

Since the second board P2 is placed on the first protruding parts 120 of the support 100, end portions 121 of the first protruding parts 120 may be horizontally bent to stably support the second board P2.

Figure 7B:
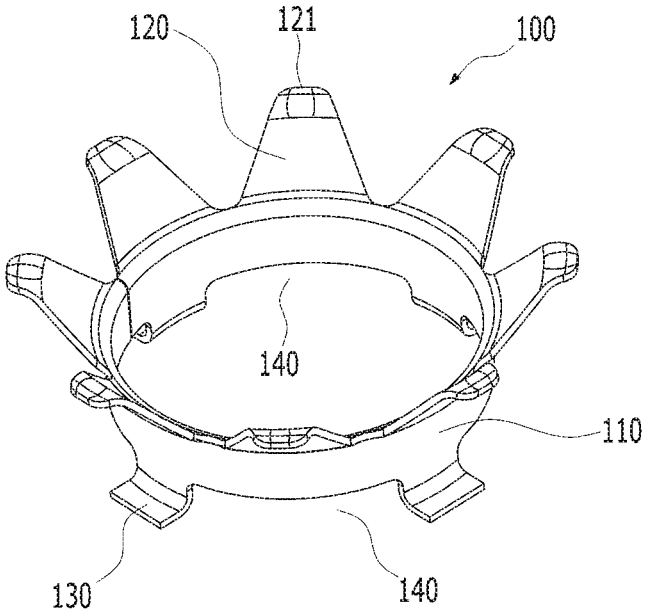
FIG. 7B is a perspective view illustrating a modification of the support of the board to board connector of FIG. 2.

Referring to FIG. 7B illustrating a modification of the board to board connector in accordance with the embodiment of the disclosure, the first protruding parts 120 of the support 100 may have first protrusions 121*a* formed on the surfaces of the end portions 121 thereof, in order to improve an adhesion force between the first protruding parts 120 and the bottom surface of the second board P2.

Figure 8A:
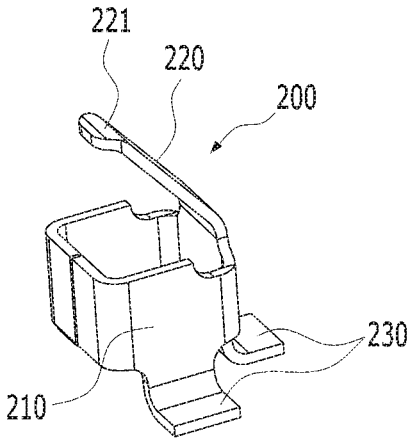
FIG. 8A is a perspective view illustrating a terminal of the board to board connector of FIG. 2.

The terminal 200 has one terminal fixedly coupled to the first board P1 and the other terminal coupled to the second board P2 in a contact manner, and serves to electrically connect a signal line of the first board P1 positioned on one side thereof to a signal line of the second board P2 positioned on the other side thereof. As illustrated in FIG. 8A, the terminal 200 may be disposed in an internal space of the circumference part 110 of the support 100, and include a body 210 having an internal space of which the top and bottom are open, a second protruding part 220 protruding from the top of the body in an obliquely upward direction, and one or more second fixing parts 230 protruding outward from the bottom of the body 210 in a horizontal direction. The terminal 200 may be made of a metal with excellent electrical conductivity. For example, the terminal 200 may be made of beryllium, KS-D-5102 C1720 or another metallic material. The second fixing part 230 is fixedly mounted on the first board P1. For example, the second fixing part 230 of the terminal 200 may be coupled to the surface of the first board P1 such as a PCB through soldering by an SMD. However, the present embodiment is not limited thereto, but the second fixing part 230 may be inserted and fixed to the first board P1. When the second fixing part 230 of the terminal 200 is coupled to the first board P1 by soldering, it is desirable that the second fixing part 230 protrudes horizontally from the bottom of the body 210 of the terminal 200 to the outside.

The second board P2 may be coupled to the top of the second protruding part 220 protruding from the top of the body 210 of the terminal 200 in a contact manner. The second protruding part 220 of the terminal 200 may have a predetermined elastic force to stably connect to the second board P2 even when the second board P2 is not aligned parallel to the first board P1.

Since the second board P2 is connected to the top of the second protruding part 220 of the terminal 200 in a contact manner, an end portion 221 of the second protruding part 220 may be horizontally bent for stable connection with the second board P2.

Figure 8B:
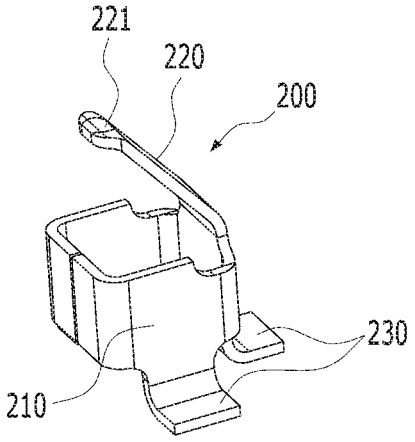
FIG. 8B is a perspective view illustrating a modification of the terminal of the board to board connector of FIG. 2.

Referring to FIG. 8B illustrating a modification of the board to board connector in accordance with the embodiment of the disclosure, the second protruding part 220 of the terminal 200 may have a second protrusion 221*a* formed on the surface of the end portion 221, in order to improve a connection force between the second protruding part 220 and a signal line exposed to the bottom surface of the second board P2.

Figure 6:
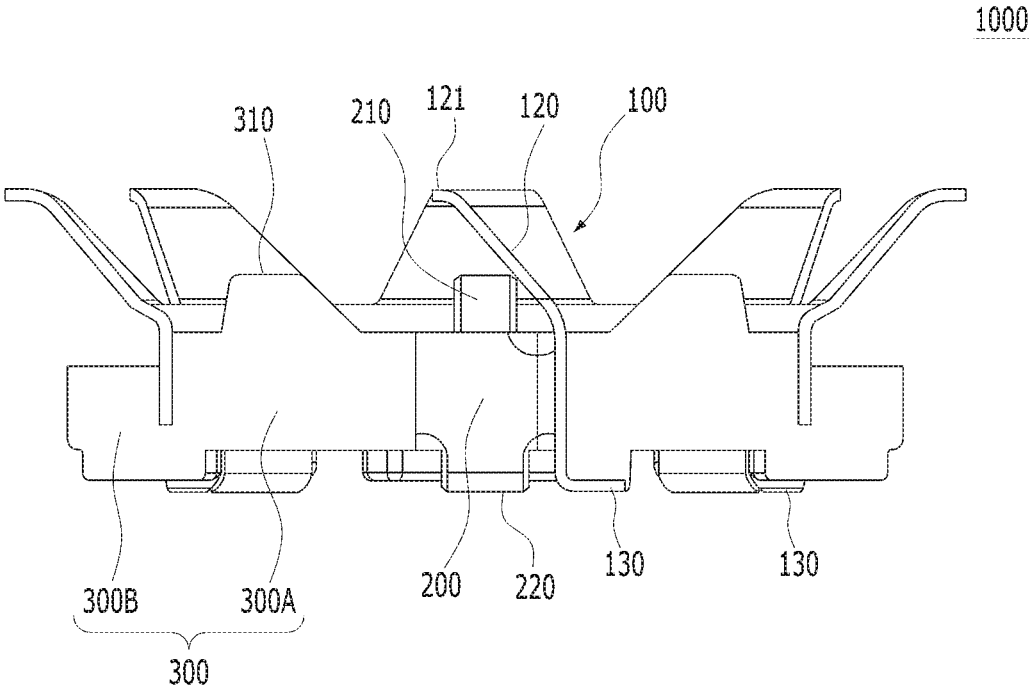
FIG. 6 is a cross-sectional view taken along a line A-A of FIG. 3.

The insulating part 300 may be provided between the support 100 and the terminal 200 and prevent a leakage of a current flowing through the terminal 200 to the outside. The insulating part 300 serves to protect the terminal 200 buried therein and prevent a short circuit, and is formed of an insulator. The insulating part 300 fixes the terminal 200 to the internal space of the support 100 while electrically insulating the support 100 from the terminal 200. As illustrated in FIG. 6, with the terminal 200 positioned on the inside of the circumference part 110 of the support 100, an insulating material is provided between the inner circumferential surface of the circumference part 110 of the support 100 and the outer circumferential surface of the body 210 of the terminal 200, thereby fixing the terminal 200 to the internal space of the support 100. The insulating part 300 may be formed of resin. With the terminal 200 positioned on the inside of the circumference part 110 of the support 100, an insulating material may be formed between the support 100 and the terminal 200 by injection molding, thereby coupling the support 100 to the terminal 200. As such, with the terminal 200 fixed at a predetermined internal position of the circumference part 110 of the support 100 in a mold, the support 100 and the terminal 200 may be coupled as one body through an insulating material and manufactured as a complete product by injection molding, without a process of assembling the support 100 and the terminal 200 to produce the connector. Therefore, it is possible to produce connectors having the same standards, thereby improving the quality stability of products. The insulating part used for the board to board connector in accordance with the embodiment of the disclosure may be made of resin which has electrical insulating properties and an excellent adhesion force between the support 100 and the terminal 200. For example, LCP S475 (Black) having a dielectric constant of 3.7 may be used. Furthermore, fluorine resin such as PTFE (Poly Tetra Fluoro Ethylene) may be used as the material of the insulating part. The present embodiment is not limited thereto, but rubber, urethane, plastic and the like, which have insulating properties, may also be used.

The insulating part 300 of the board to board connector 1000 in accordance with the embodiment of the disclosure basically serves to electrically insulate and couple the support 100 and the terminal 200 from each other while coupling the support 100 and the terminal 200 to each other. Therefore, the insulating material may be provided only between the inner circumferential surface of the circumference part 110 of the support 100 and the outer circumferential surface of the body 210 of the terminal 200. However, in order to improve the load supporting force of the support 100 in the connector 1000 while electrically insulating the outer circumferential surface of the circumference part 110 of the support 100, an outer insulating part 300B may be additionally disposed on the outside of the circumference part 110 so as to surround the outer circumferential surface of the circumference part 110 of the support 100. In this case, as illustrated in FIGS. 7A and 7B, one or more cutouts 140 may be formed at the bottom of the circumference part 110 of the support 100, such that the insulating part 300 can reliably support the support 100 through the bottom of the support 100.

In the board to board connector 1000 in accordance with the embodiment of the disclosure, the first fixing part 130 of the support 100 is fixed to the first board P1, the first protruding part 120 of the support 100 protrudes outward in an obliquely upward direction such that the end portion 121 thereof supports the bottom surface of the second board P2, and the first protruding part 120 has an elastic force to stably support the second board P2 even when the second board P2 is not aligned in parallel to the first board P1. However, when an excessive load is applied to the second board P2, the first protruding part 120 may be permanently strained while deflection of the first protruding part 120 is increased. In this case, the first protruding part 120 may lose the elastic force. Therefore, the board to board connector 1000 may include a stopper for controlling the deflection of the first protruding part 120 such that the first protruding part 120 is not permanently strained. In the board to board connector 1000 in accordance with the embodiment of the disclosure, a stopper 310 having a predetermined height h may be formed on the top surface of an inner insulating part 300A as illustrated in FIG. 6, in order to limit the distance by which the second board P2 is moved toward the first board P1. For example, the height h of the stopper 310 may be set in such a manner that a downward displacement of the second board P2 does not exceed approximately 0.55 mm, when the second board P2 contacted with the top of the first protruding part 120 of the support 100 is moved toward the first board P1 by pressure.

Figure 2:
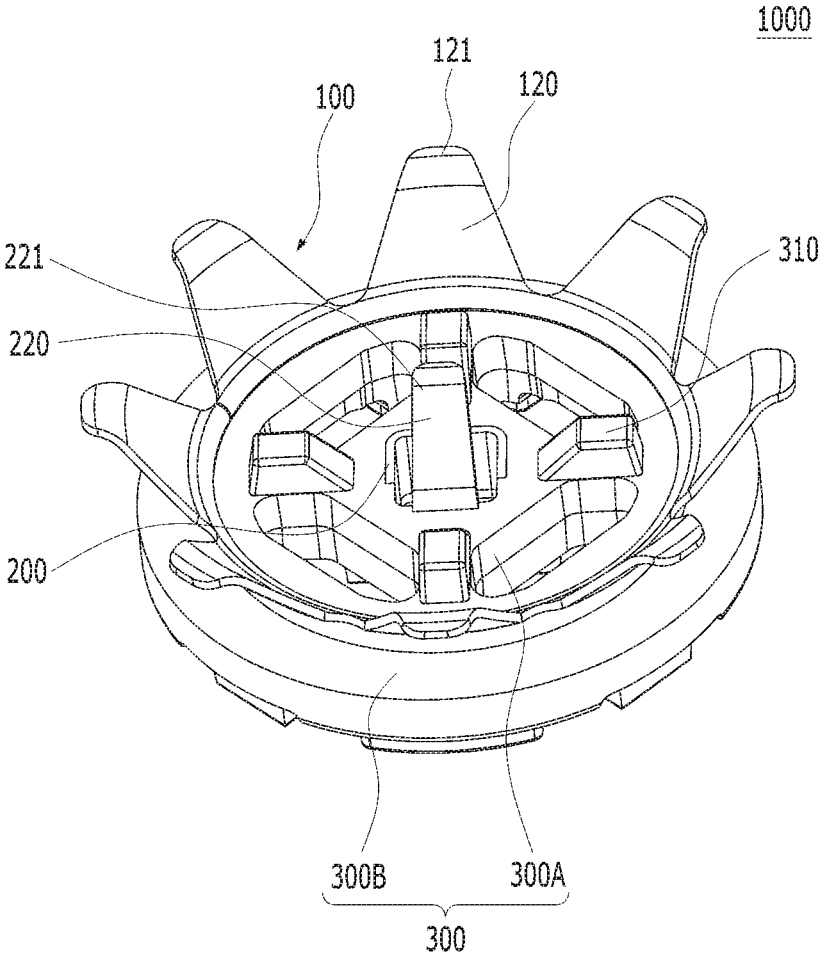
FIG. 2 is a perspective view illustrating a board to board connector in accordance with an embodiment of the disclosure.
Figure 3:
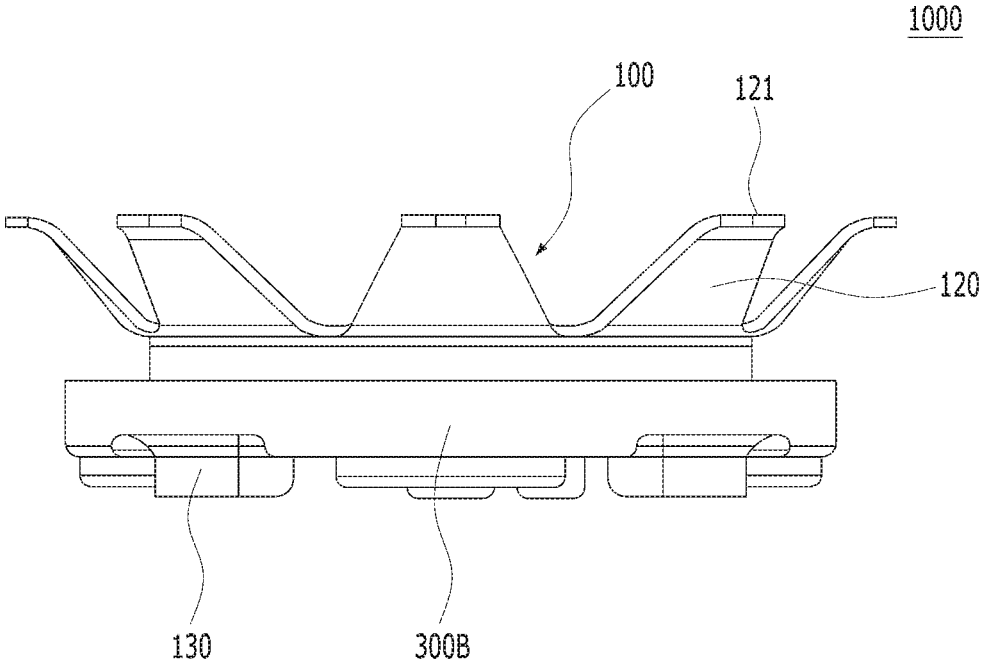
FIG. 3 is a plan view illustrating the board to board connector of FIG. 2.
Figure 4:
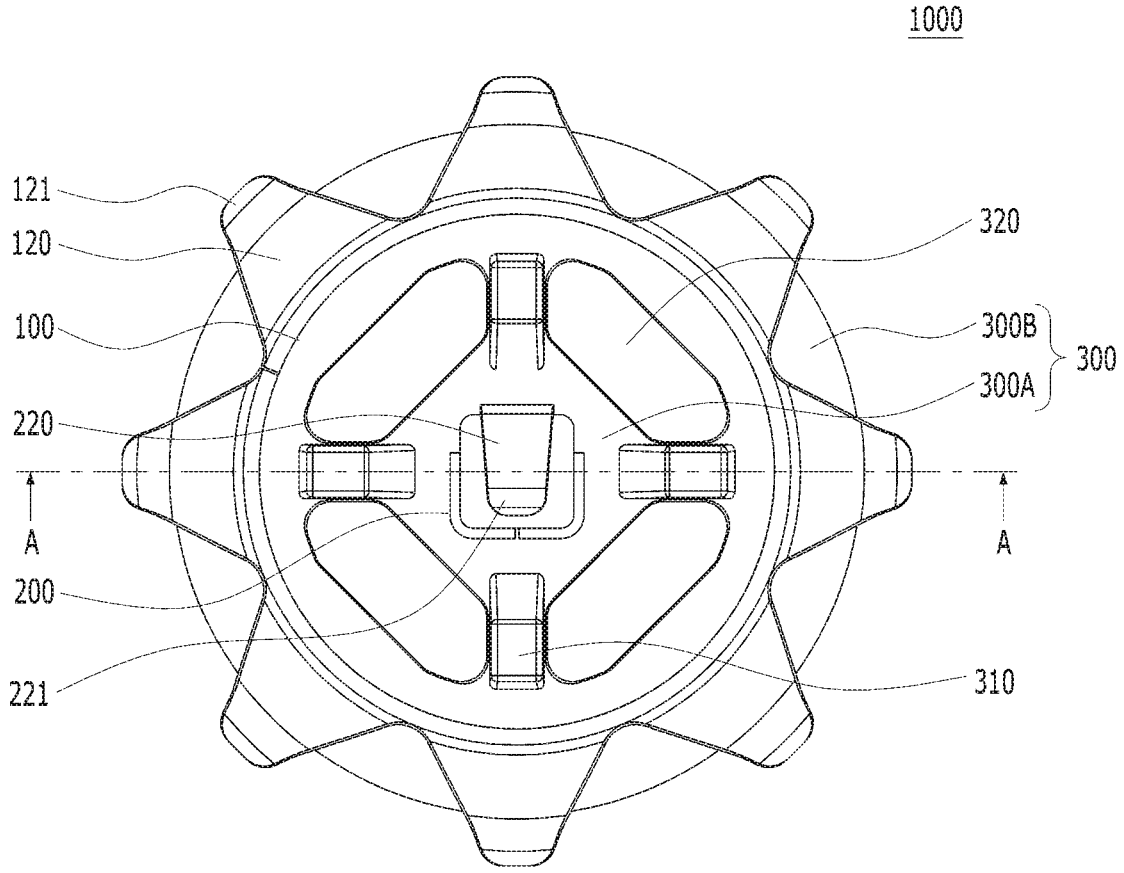
FIG. 4 is a front view illustrating the board to board connector of FIG. 2.
Figure 5:
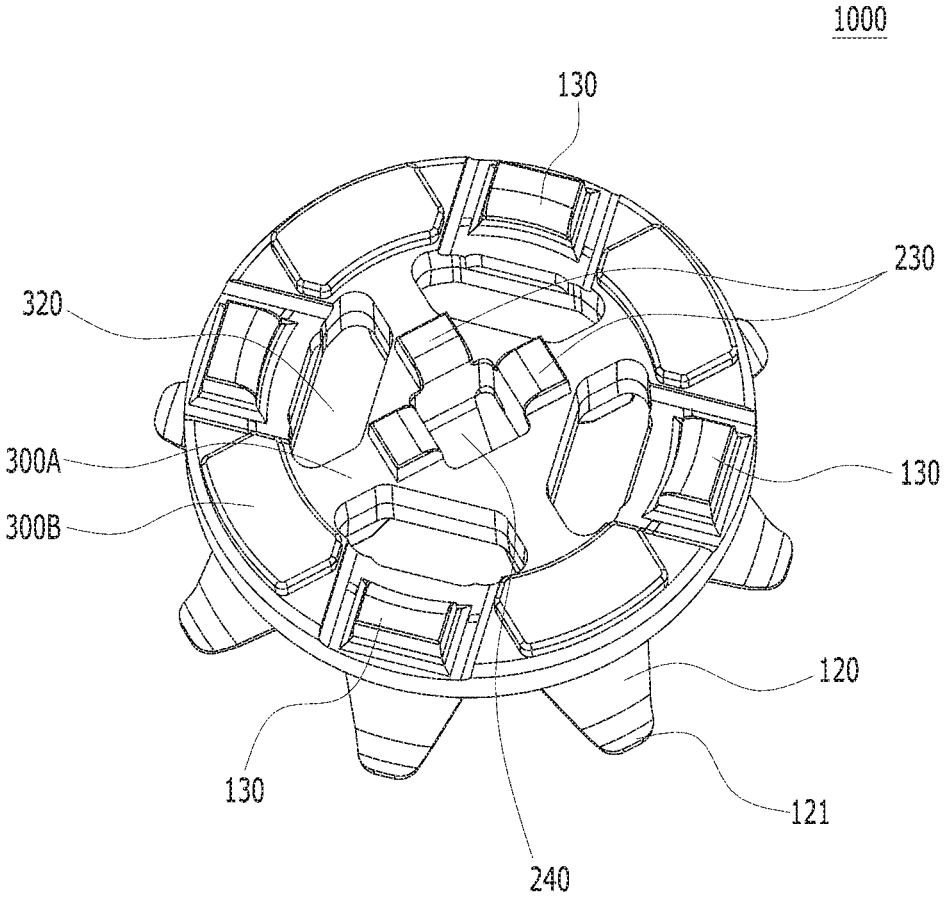
FIG. 5 is a perspective view illustrating the board to board connector of FIG. 2, seen from the bottom.

Since the board to board connector 1000 in accordance with the embodiment of the disclosure electrically connects the first and second boards P1 and P2, a current is conducted to the terminal 200 of the connector 1000 to generate heat. In order to efficiently dissipate the heat generated from the terminal 200 of the connector 1000, one or more air flow paths 320 may be formed through the inner insulating part 300A surrounding the terminal 200 as illustrated in FIGS. 2 and 4. Such an air flow path 320 may be formed in the inner insulating part 300A at the same time when the connector in accordance with the embodiment of the disclosure is manufactured through an injection molding process.

In the board to board connector 1000 in accordance with the embodiment of the disclosure, the terminal 200 may be formed as a hollow body such that the body 210 has an empty space therein. As illustrated in FIGS. 8A and 8B, the body 210 of the terminal 200 may be formed in a rectangular shape, such that the position of the terminal 200 disposed in the support 100 in the mold can be accurately set when the connector 1000 in accordance with the embodiment of the disclosure is produced by injection molding. As such, when the body 210 is formed in a rectangular shape, the relative position of the terminal 200 with respect to the support 100 may be easily set by means of four surfaces of the rectangular body. Furthermore, one or more protrusions (not illustrated) which protrude outward may be formed on the outer surface of the body 210 of the terminal 200, in order to reliably maintain the coupling with the insulating part 300.

Next, referring to FIGS. 9A and 9B, an operation of the board to board connector 1000 in accordance with an embodiment of the disclosure will be described.

Figure 9A:
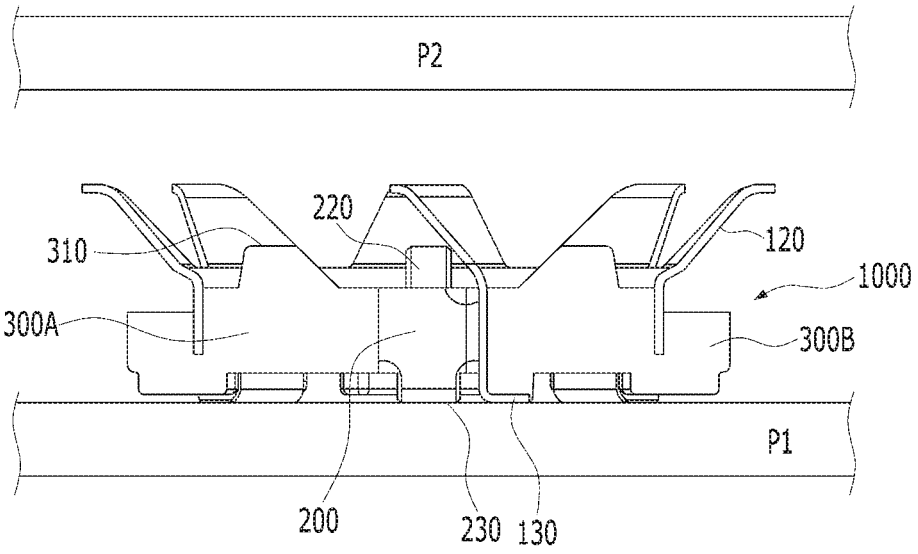
FIGS. 9A and 9B are diagrams for describing an operation of a board to board connector in accordance with an embodiment of the disclosure.

FIG. 9A illustrates that the second board P2 is positioned over the board to board connector 1000 with the connector 1000 fixed to the first board P1, and FIG. 9A illustrates that the second board P2 is moved toward the first board P1 in the state of FIG. 9A by pressure applied to the second board P2.

Figure 9B:
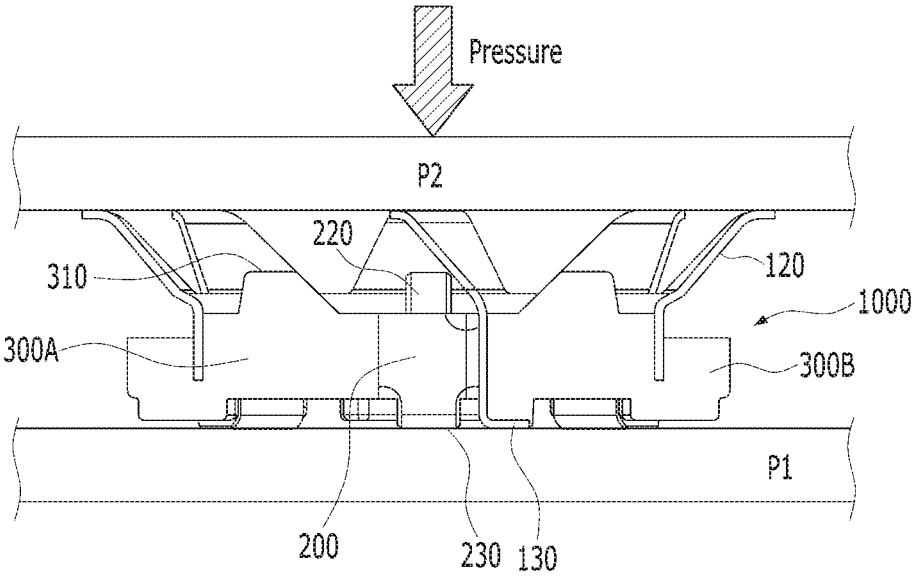

Although the second board P2 positioned over the board to board connector 100 is pressed downward as illustrated in FIG. 9B, the elastic supporting operation of the one or more first protruding parts 120 protruding outward in an obliquely upward direction across the circumference of the connector 1000 can prevent the second board P2 from being misaligned with respect to the first board P1 positioned under the connector 1000.

Next, a modification of the board to board connector in accordance with the embodiment of the disclosure will be described with reference to FIGS. 10 and 11. When components of the board to board connector in accordance with the modification illustrated in FIGS. 10 and 11 are described, the same components as those illustrated in FIGS. 2 to 9 will be represented by like reference numerals, and the detailed descriptions thereof will be omitted herein.

Figure 10:
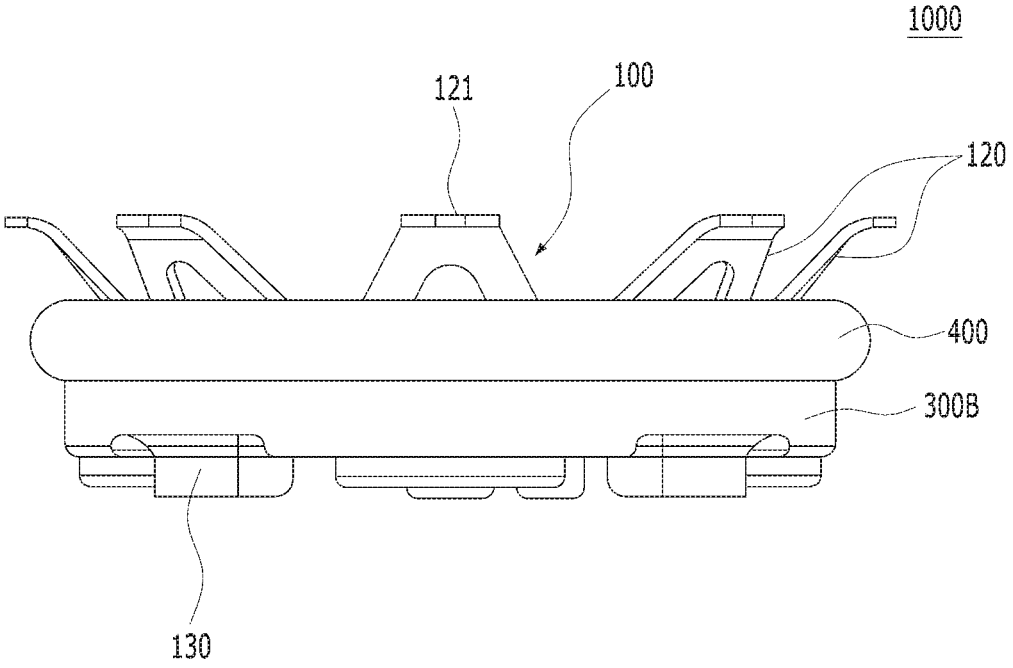
FIG. 10 is a front view illustrating a modification of the board to board connector in accordance with the embodiment of the disclosure.
Figure 11:
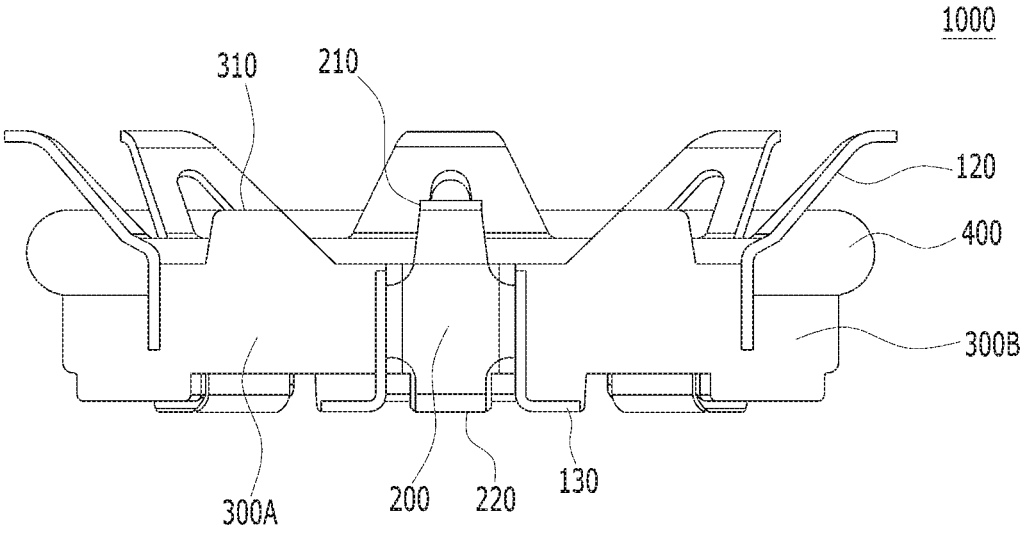
FIG. 11 is a cross-sectional view illustrating the board to board connector of FIG. 10, corresponding to FIG. 6.

FIG. 10 is a front view illustrating the modification of the board to board connector in accordance with the embodiment of the disclosure, and FIG. 11 is a cross-sectional view illustrating the board to board connector of FIG. 10, corresponding to FIG. 6.

As illustrated in FIGS. 10 and 11, the modification of the board to board connector in accordance with the embodiment of the disclosure may additionally include an O-ring 400 disposed on the outer circumference of the first protruding part 120 of the support of 100 at the top of the outer insulating part 300B. The O-ring 400 may have an inner diameter equal to or smaller than the outer diameter of the outer circumference of the first protruding part 120, but the present embodiment is not limited thereto. In such a structure, the O-ring 400 may share a load transferred from the second board P2 to the first protruding part 120 of the support 100 and complement the elastic force of the first protruding part 120, thereby improving the durability of the board to board connector. The O-ring 400 may be formed in a circular ring shape, and made of an elastic material having a predetermined elastic force, such as silicone, natural rubber, synthetic rubber, synthetic resin, etc.

Next, a modification of the board to board connector in accordance with the embodiment of the disclosure will be described with reference to FIGS. 12 and 13. When components of the board to board connector in accordance with the modification illustrated in FIGS. 12 and 13 are described, the same components as those of the embodiments illustrated in FIGS. 2 to 11 will be represented by like reference numerals, and the detailed descriptions thereof will be omitted herein.

Figure 12:
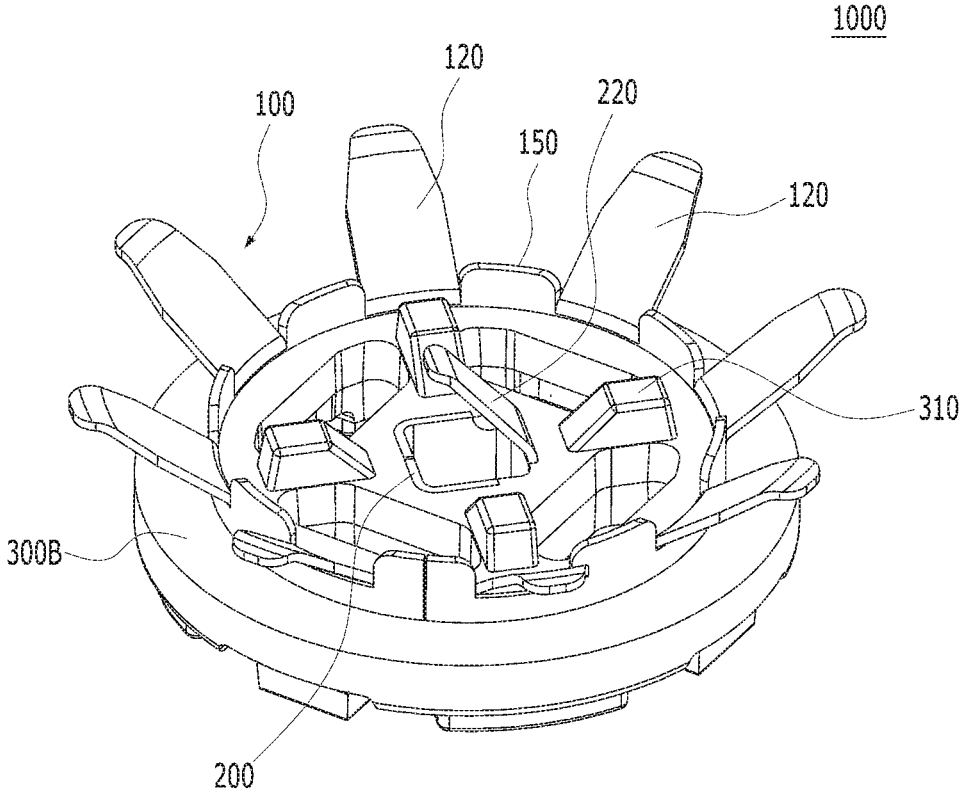
FIG. 12 is a perspective view illustrating a board to board connector in accordance with the embodiment of the disclosure.
Figure 13:
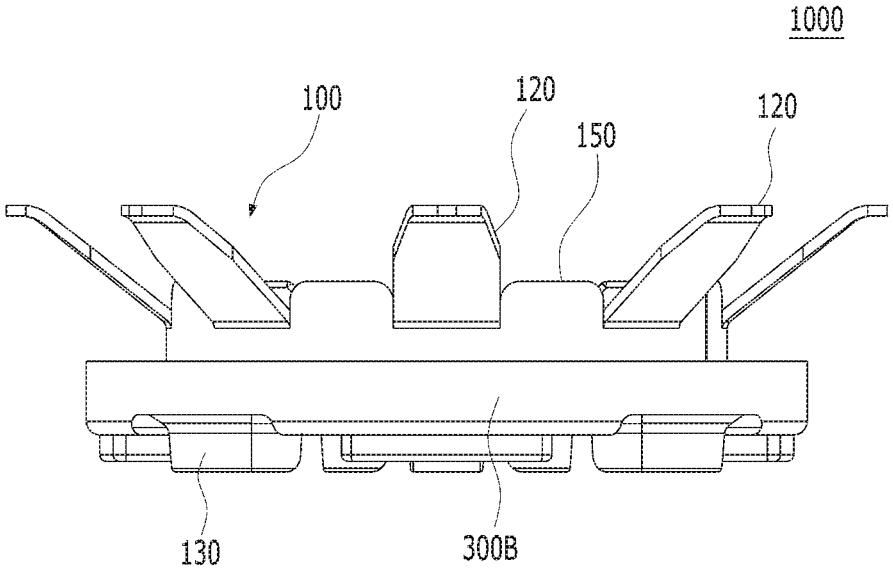
FIG. 13 is a front view illustrating the board to board connector of FIG. 12.

FIG. 12 is a perspective view illustrating a modification of the board to board connector in accordance with the embodiment of the disclosure, and FIG. 13 is a front view illustrating the board to board connector of FIG. 12.

As illustrated in FIGS. 12 and 13, the support 100 in the modification of the board to board connector in accordance with the embodiment of the disclosure may include a plurality of first protruding parts 120, and a plurality of RF (Radio Frequency) signal leakage prevention members 150 may be formed between the respective first protruding parts 120 so as to vertically protrude. Such a structure can efficiently prevent an RF signal loss which may occur while the RF signal leaks to the outside through spaces between the respective first protruding parts 120. In the present embodiment, the RF signal leakage prevention members 150 may be formed as one body with the support 100 and have the same height as the stopper 310 formed at the top of the inner insulating part 300A. However, the present embodiment is not limited thereto.

Next, a structure of a board to board connector in accordance with another embodiment of the disclosure will be described with reference to FIGS. 13 to 18, and the state in which two boards are electrically connected to each other by pressing a second board disposed over the board to board connector toward the board to board connector with the board to board connector fixed to a first board disposed thereunder will be described with reference to FIGS. 19A and 19B.

Figure 14:
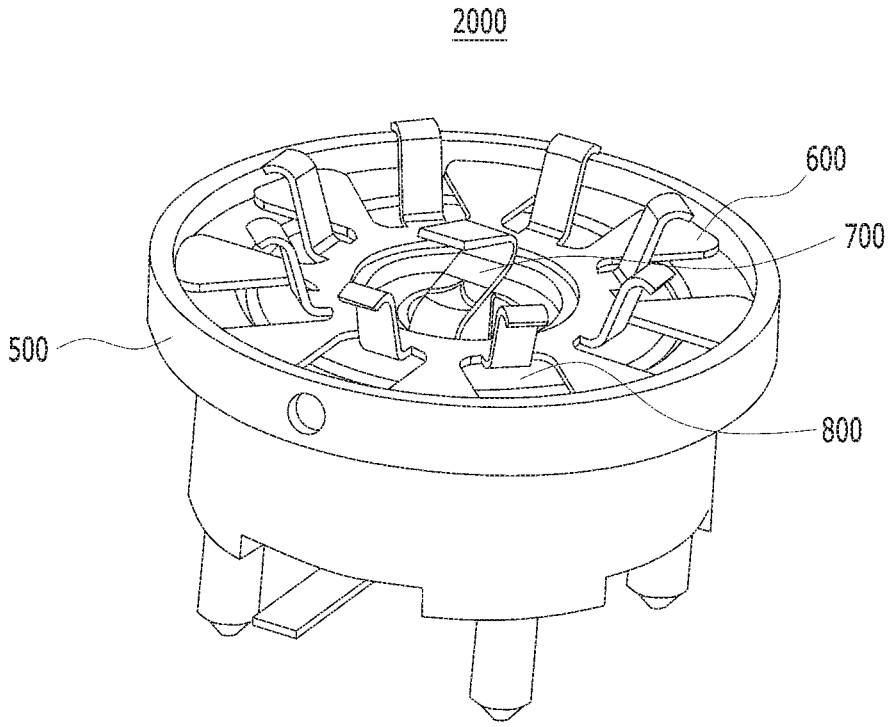
FIG. 14 is a perspective view illustrating a board to board connector in accordance with another embodiment of the disclosure.

FIG. 14 is a perspective view illustrating a board to board connector 2000 in accordance with another embodiment of the disclosure.

Referring to FIG. 14, the board to board connector 2000 serves to couple two different PCBs, and includes a terminal 700, an insulating part 800, a support 600 and a shell 500.

Figure 15A:
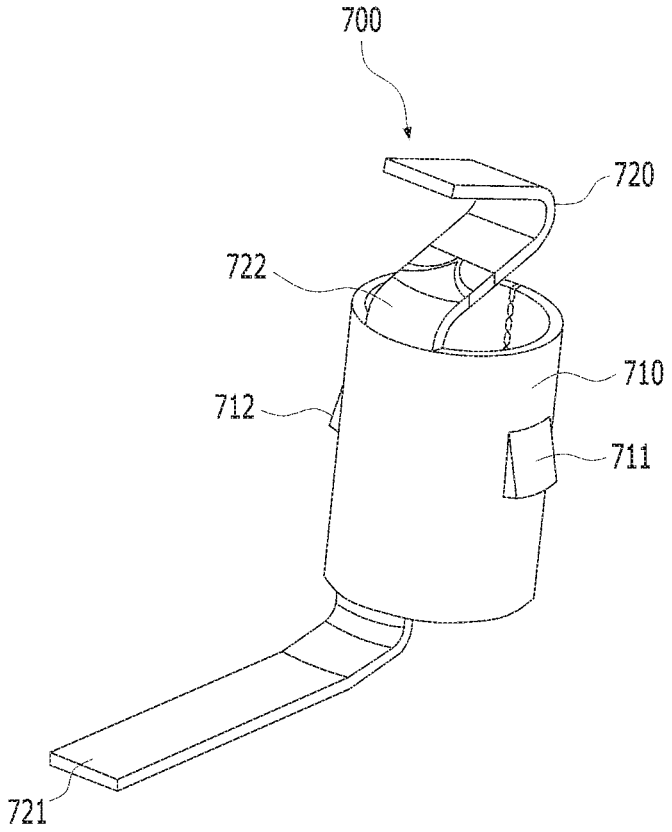
FIG. 15A is a perspective view illustrating a terminal of the board to board connector of FIG. 14.

The terminal 700 serves to elastically connect a signal line of a board positioned on one side thereof (for example, top) to a signal line of a board positioned on the other side thereof (for example, bottom). Such a terminal 700 may be implemented in the form of a contact pin as illustrated in FIG. 15A. FIG. 15A is a perspective view illustrating the terminal constituting the board to board connector. Referring to FIG. 15A, the terminal 700 includes a body 710 and a connection member 720. The body 710 may be formed in a hollow cylinder shape, and the connection member 720 may be fixed to one side of the inside of the body 710. In the board to board connector 2000 in accordance with the embodiment of the disclosure, the body 710 is not limited to the cylinder shape. For example, the body 710 can be formed in an oval cylinder shape having an oval horizontal cross-section, a polygonal cylinder shape having a polygonal horizontal cross-section, or a hexahedron shape such as a rectangular hexahedron or a rectangular parallelepiped. The body 710 may have two protrusions 711 and 712 formed on the outside thereof, and thus can be inserted into the board to board connector 2000 so as to be supported by the insulating part 800.

The first and second protrusions 711 and 712 formed on the outer surface of the body 710 may protrude in an orthogonal direction from the outer surface of the body 710. However, the present embodiment is not limited thereto. The first and second protrusions 711 and 712 may be formed at a predetermined angle smaller than 90° with respect to the outer surface of the body 710, i.e. an angle equal to or more than 0° and less than 90°, in order to minimize pitching of the terminal 700.

The connection member 720 has a pin shape elongated in one direction. When the connection member 720 is fixed to one side of the inside of the body 710, parts of the connection member 720 may protrude from both open sides of the body 710. For convenience of description, both open sides of the body 710 may be referred to as the top and bottom of the body 710. Hereinafter, one side of the connection member 720 protruding from the top of the body 710 is defined as a second side part 722, and the other side of the connection member 720 protruding from the bottom of the body 710 is defined as a first side part 721.

The second side part 722 of the connection member 720 is contacted with the second board P2 positioned at the top, and the first side part 721 of the connection member 720 is contacted with the first board P1 positioned at the bottom. Considering that the board to board connector 2000 is pressed against and coupled to the first board P1 through the shell 500, the first side part 721 of the connection member 720 may be bent once and elongated in one direction. In the present embodiment, however, the shell 500 is not contacted with the second board P2, unlike the case of the first board P1. Therefore, the second side part 722 of the connection member 720 may be bent at least twice and elongated in the other direction in consideration of such an aspect. Such a characteristic of the second side part 722 of the connection member 720 may be effectively used to electrically connect the first and second boards.

The connection member 720 may be made of a metallic material to electrically connect a signal line of the first board and a signal line of the second board. For example, the connection member 720 may be made of beryllium. The body 710 may also be made of a metallic material (e.g. beryllium), like the connection member 720. The present embodiment is not limited thereto.

Figure 15B:
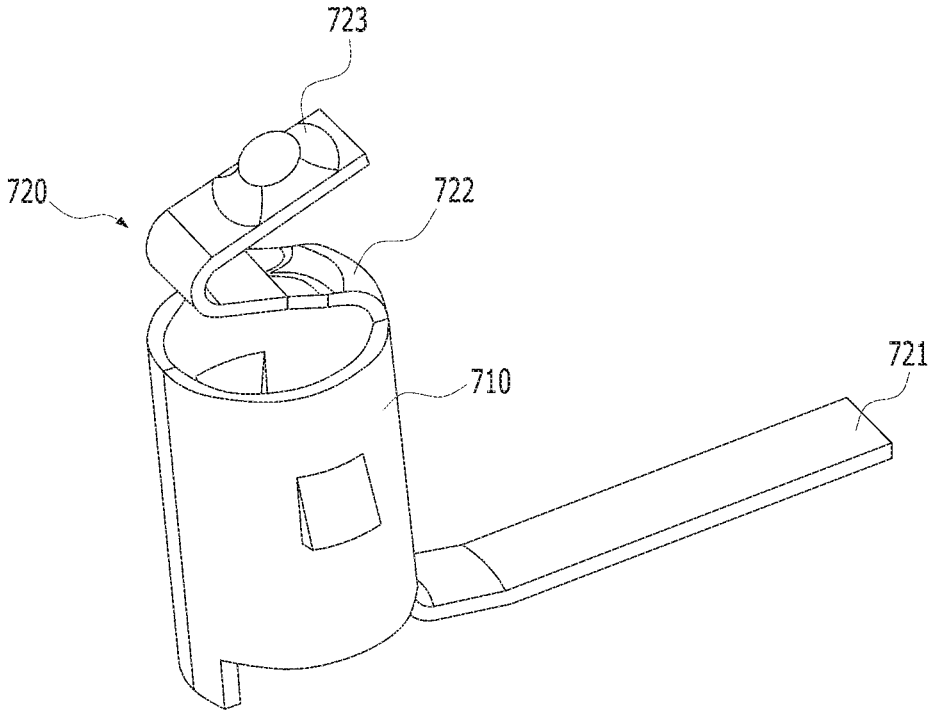
FIG. 15B is a perspective view illustrating a modification of the terminal of the board to board connector of FIG. 14.
Figure 16:
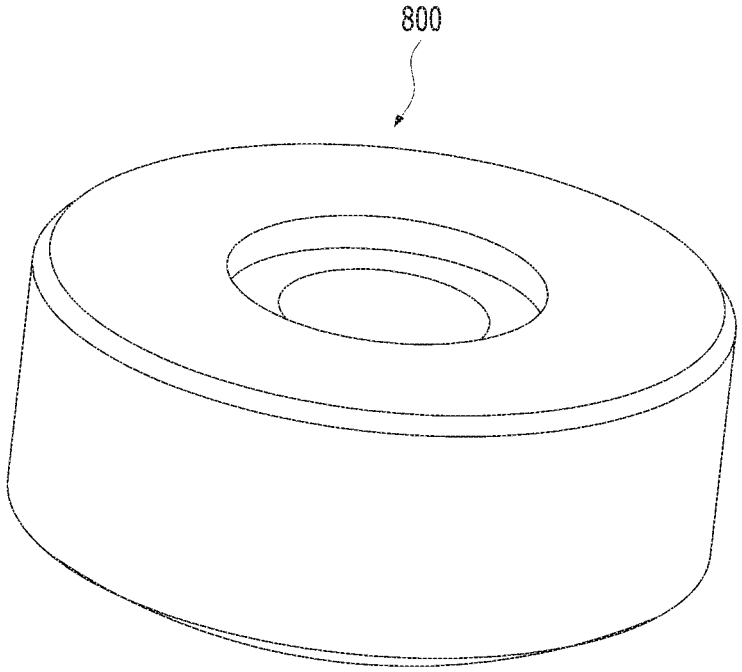
FIG. 16 is a perspective view illustrating an insulating part of the board to board connector of FIG. 14.

As illustrated in FIG. 15B, a modification of the board to board connector in accordance with the embodiment of the disclosure may include a second protrusion 723 formed on the surface of the second side part 722 of the connection member 720 in the terminal 700, in order to improve a connection force between the second side part 722 and a signal line exposed to the bottom surface of the second board P2.

The insulating part 800 serves to prevent a current flowing through the terminal 700 from leaking to the outside. The insulating part 800 serves to prevent a short-circuit while protecting the terminal 700 positioned therein. The insulating part 800 may be implemented as an insulator as illustrated in FIG. 14.

The insulating part 800 may be formed in a hollow cylinder shape such that the terminal 700 can be inserted into the insulating part 800. The insulating part 800 may be formed of an insulating material having an excellent insulating property. The insulating part 800 may be formed of fluorine resin, for example, PTFE (Poly Tetra Fluoro Ethylene), in order to raise the adhesion to the terminal 700 positioned in the insulating part 800 while improving the electrical insulating property.

The support 600 is positioned over the insulating part 800 and coupled to the shell 500. Such a support 600 also serves to prevent the first board positioned thereon from being pushed by the terminal 700. In the present embodiment, the support 600 may be implemented in the form of an outer conductor as illustrated in FIG. 15A.

Figure 17A:
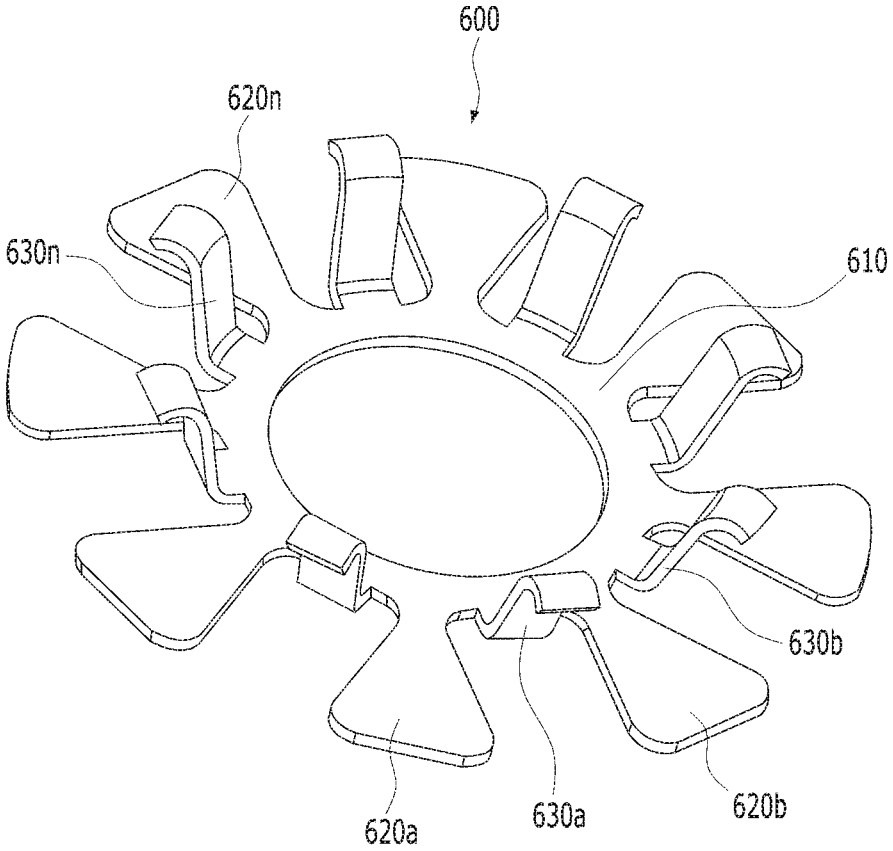
FIG. 17A is a perspective view illustrating a support of the board to board connector of FIG. 14.

In order to effectively implement the coupling with the shell 500, the support 600 includes a body 610, first protruding parts 620*a*, 620*b*, . . . , 620*n* and second protruding parts 630*a*, 630*b*, . . . , 630*n* as illustrated in FIG. 17A. The body 610 is formed in a ring shape such that the terminal 700 can be inserted into the body 610. The first protruding parts 620*a*, 620*b*, . . . , 620*n* protrude from the outside of the body 610 in one direction. In the present embodiment, the support 600 includes one or more first protruding parts 620*a*, 620*b*, . . . , 620*n*. The first protruding parts 620*a*, 620*b*, . . . , 620*n* may protrude from the body 610 in an outward direction (parallel to the plane of the body). The support 600 may be fitted into a groove 530 formed at one inner circumference of the shell 500 through the first protruding parts 620*a*, 620*b*, . . . , 620*n*, thereby implementing the coupling with the shell 500.

In another embodiment, one or two first protruding parts 620*a*, 620*b*, . . . , 620*n* may be provided. However, in order to raise a connection force with the shell 500, three or more first protruding parts 620*a*, 620*b*, . . . , 620*n* may be provided.

The second protruding parts 630*a*, 630*b*, . . . , 630*n* protrude from the outside of the body 610 in a different direction from the protruding direction of the first protruding parts 620*a*, 620*b*, . . . , 620*n*, i.e. a direction facing a board. In the present embodiment, one or more second protruding parts 630*a*, 630*b*, . . . , 630*n* may be provided together with the one or more first protruding parts 620*a*, 620*b*, . . . , 620*n*. The second protruding parts 630*a*, 630*b*, . . . , 630*n* may protrude upward from the outside of the body 610. The support 600 is contacted with the ground of the second board P2 positioned over the support 600 through the second protruding parts 630*a*, 630*b*, . . . , 630*n*. Furthermore, the plurality of second protruding parts 630*a*, 630*b*, . . . , 630*n* protruding in the upward direction may ensure a stable contact with the ground, even when the board connected to the second protruding parts 630*a*, 630*b*, . . . , 630*n* is not horizontally disposed.

In order to ensure stable connection with the ground even when the second board P2 is not disposed parallel to the first board P1 but slightly tilted, three or more second protruding parts 630*a*, 630*b*, . . . , 630*n* may be formed on the circumference in the present embodiment.

In the present embodiment, when the plurality of first protruding parts 620*a*, 620*b*, . . . , 620*n* and the plurality of second protruding parts 630*a*, 630*b*, . . . , 630*n* are provided, the first protruding parts and the second protruding parts may be alternately disposed. Thus, the support 600 may be manufactured to have the same number of first protruding parts 620*a*, 620*b*, . . . , 620*n* and the same number of second protruding parts 630*a*, 630*b*, . . . , 630*n*. However, depending on the importance levels of the first protruding parts 620*a*,

620*b*, . . . , 620*n* and the second protruding parts 630*a*, 630*b*, . . . , 630*n*, two or more second protruding parts may be disposed between two first protruding parts, or one second protruding part may be disposed among three or more first protruding parts.

The second protruding parts 630*a*, 630*b*, . . . , 630*n* of the support 600 of the connector 2000 which is disposed between the first and second boards P1 and P2 so as to connect the boards may be bent at least twice and elongated in one direction, in order to minimize separation of the second protruding parts 630*a*, 630*b*, . . . , 630*n* from the bottom surface of the second board P2. On the other hand, the first protruding parts 620*a*, 620*b*, . . . , 620*n* may not be bent but flattened and coupled to the shell 500.

Figure 17B:
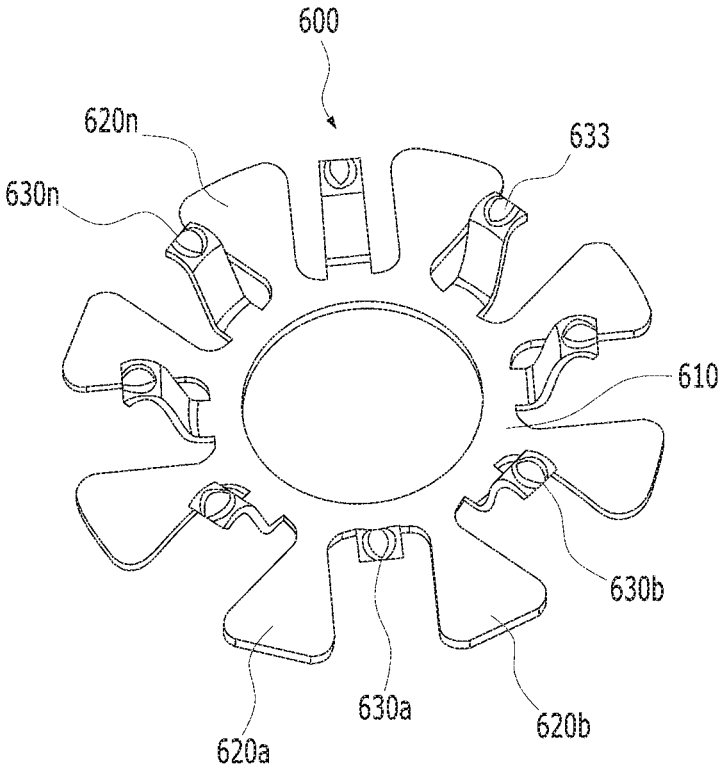
FIG. 17B is a perspective view illustrating a modification of the support of the board to board connector of FIG. 14.

As illustrated in FIG. 17B, a modification of the board to board connector in accordance with the embodiment of the disclosure may include protrusions 633 formed on the surfaces of end portions of the second protruding parts 630*a*, 630*b*, . . . , 630*n* in the support 600, in order to improve an adhesion force between the second protruding parts and the bottom surface of the second board P2.

The support 600 may be formed of a metallic material. For example, the support 600 may be formed of beryllium. In the present embodiment, however, the support 600 is not limited to a metallic material. The support 600 may be manufactured in the form of a board plank.

Figure 18A:
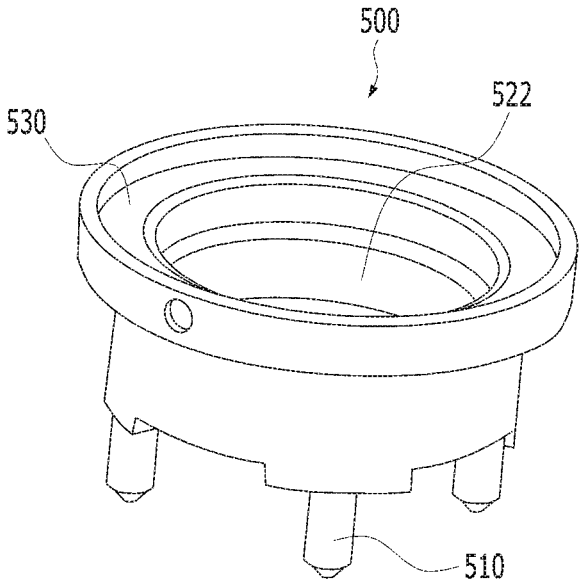
FIGS. 18A and 18B are perspective views illustrating a shell of the board to board connector of FIG. 14.
Figure 18B:
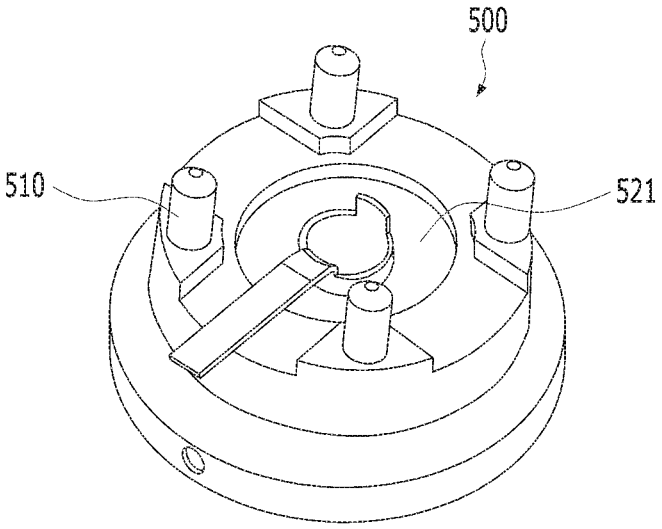

The shell 500 is disposed at the edge of the insulating part 800, serves as a lid for the insulating part 800, and electrically has a ground potential. The shell 500 may have a structure of which a top is completely open and a bottom is partially open. The shell 500 may be formed in a cylinder shape such that the insulating part 800 can be embedded in the shell 500. The shell 500 may be formed in a shell shape as illustrated in FIG. 18. FIGS. 18A and 18B are perspective views illustrating the shell constituting the board to board connector. FIG. 18A is a perspective view of the shell, seen from the top, and FIG. 18B is a perspective view of the bottom surface of the shell.

The shell 500 has one or more legs 510 formed at the bottom thereof so as to be fixed to the first board P1 positioned thereunder. In another embodiment, the shell 500 may include one or more legs 510. In the present embodiment, however, the shell 500 may include three or more legs 510 so as to be reliably fixed to the first board P1. The plurality of legs 510 included in the shell 500 may not be eccentrically formed on one side thereof, but evenly distributed on the circumference thereof. The plurality of legs 510 are electrically connected to the ground of the first board P1, in order to achieve connection to the ground.

As described above, the shell 500 has a structure of which the top is completely open and the bottom is partially open. When the terminal 700 and the insulating part 800 are inserted into the shell 500 together, the first side part 721 of the connection member 720 formed on the terminal 700 is exposed to the outside through a first hole 521 formed at the bottom of the shell 500. Then, when the shell 500 is coupled and fixed to the first board P1 through the legs 510, the first side part 721 of the connection member 720 exposed through the first hole 521 is pressed against the first board and achieves electrical connection with the first board.

On the other hand, when the terminal 700 and the insulating part 800 are inserted into the shell 500 together, the second side part 722 of the connection member 720 formed on the terminal 700 is exposed to the outside through a second hole 522 formed at the top of the shell 500. At this time, the second side part 722 of the connection member 720 is pressed against the second board P2 positioned over the connection member 720 and achieves electrical connection with the second board.

The shell 500 has a groove 530 formed on an upper circumferential surface thereof. At this time, the first protruding parts 620*a*, 620*b*, . . . , 620*n* of the support 600 may be fitted into the groove 530, thereby fixing the support 600 to the shell 500. Furthermore, the fixing between the support 600 and the shell 500 can prevent the terminal 700 and the insulating part 800 from coming out of the shell 500 to the outside due to an external impact.

The shell 500 may be formed of a metallic material and manufactured according to various methods including pressing and die casting.

Next, referring to FIGS. 19A and 19B, an operation of the board to board connector in accordance with another embodiment of the disclosure will be described. The operation of the board to board connector in accordance with the present embodiment is performed in a similar manner to the operation of the board to board connector in accordance with the embodiment of FIGS. 9A and 9B.

Figure 19A:
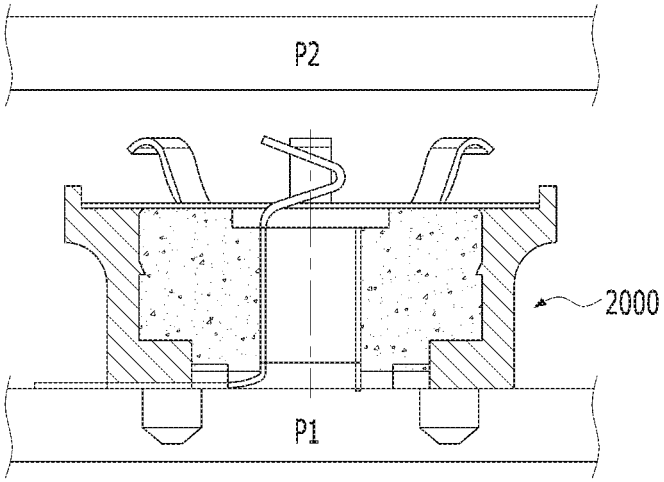
FIGS. 19A and 19B are diagrams for describing an operation of a board to board connector in accordance with another embodiment of the disclosure.
Figure 19B:
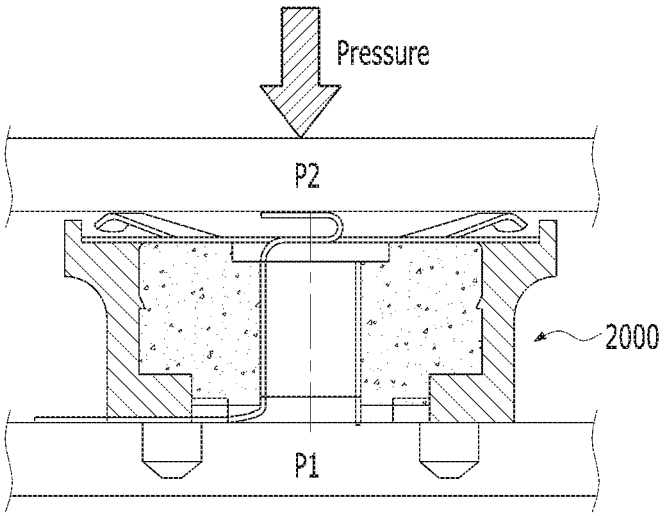

Referring to FIGS. 19A and 19B, when the second board P2 positioned over the board to board connector 2000 is pressed downward, one or more second protruding parts 630*a*, 630*b*, . . . , 630*n* of the support 600, which are formed across one circumference so as to be bent outward, are elastically pressed against the bottom surface of the second board P2. Thus, although the distances between the bottom board and the top board to which the connector is coupled are not equal, the second protruding parts as well as the terminal 700 of the connector 2000 can be completely pressed against the bottom surface of the second board P2. Therefore, the terminal 700 of the connector 2000 and/or the second protruding parts can be prevented from being separated from the bottom surface of the second board P2.

The board to board connector 2000 in accordance with the present embodiment may be implemented in the form of a push prevention bump and a press contact pin considering contact pin impedance. The board to board connector 2000 may be implemented according to a contact pin PCB contact method and a spring ground contact method of an outer board plank.

In accordance with the embodiments of the disclosure, the board to board connector can prevent misalignment between two PCBs to be coupled and prevent abnormal electrical connection between the PCBs.

Furthermore, the board to board connector, which can compensate for misalignment to prevent abnormal electrical connection even when the alignment between the boards is distorted, has a compact structure in which the terminal and the support are formed as one body through an insulating part by injection molding and manufactured as a complete product. Therefore, the board to board connector does not require an assembling process of parts and implement a process of manufacturing products having the same specification, thereby improving the stability of product quality.

While various embodiments have been described above, it will be understood to those skilled in the art that the embodiments described are by way of example only. Accordingly, the disclosure described herein should not be limited based on the described embodiments.

What is claimed is:

1. A board to board connector which couples a first board and a second board to each other, comprising:

a support comprising: a circumference part having an internal space of which a top and a bottom are open; one or more first protruding parts protruding outward from the top of the circumference part in an obliquely upward direction; and one or more first fixing parts protruding from the bottom of the circumference part;

a terminal comprising: a body having an internal space of which a top and a bottom are open; a second protruding part protruding from the top of the body in an obliquely upward direction; and one or more second fixing parts protruding from the bottom of the body, and disposed on the inside of the circumference part of the support; and an insulating part formed between an inner circumferential surface of the circumference part of the support and an outer circumferential surface of the body of the terminal, wherein the support comprises the plurality of first protruding parts and a plurality of RF (Radio Frequency) signal leakage prevention members protruding vertically between the respective first protruding parts.

2. The board to board connector of claim 1, wherein the first protruding part of the support and the second protruding part of the terminal have an elastic force.

3. The board to board connector of claim 1, wherein the insulating part is formed of resin.

4. A board to board connector which couples a first board and a second board to each other, comprising:

a support comprising: a circumference part having an internal space of which a top and a bottom are open; one or more first protruding parts protruding outward from the top of the circumference part in an obliquely upward direction; and one or more first fixing parts protruding from the bottom of the circumference part;

a terminal comprising: a body having an internal space of which a top and a bottom are open; a second protruding part protruding from the top of the body in an obliquely upward direction; and one or more second fixing parts protruding from the bottom of the body, and disposed on the inside of the circumference part of the support; and an insulating part formed between an inner circumferential surface of the circumference part of the support and an outer circumferential surface of the body of the terminal, wherein one or more stoppers protrude from the top surface of the insulating part, wherein the stopper has a height set in a range between the height of the top of the circumference part of the support and the height of the first protruding part of the support.

5. A board to board connector which couples a first board and a second board to each other, comprising:

a support comprising: a circumference part having an internal space of which a top and a bottom are open; one or more first protruding parts protruding outward from the top of the circumference part in an obliquely upward direction; and one or more first fixing parts protruding from the bottom of the circumference part;

a terminal comprising: a body having an internal space of which a top and a bottom are open; a second protruding part protruding from the top of the body in an obliquely upward direction; and one or more second fixing parts protruding from the bottom of the body, and disposed on the inside of the circumference part of the support; and an insulating part formed between an inner circumferential surface of the circumference part of the support and an outer circumferential surface of the body of the terminal, wherein the circumference part of the support has one or more cutouts formed at the bottom thereof, and the insulating part additionally comprises an outer insulating part disposed on the outside of the circumference part of the support.

6. The board to board connector of claim 1, wherein the insulating part formed between the inner circumferential surface of the circumference part of the support and the outer circumferential surface of the body of the terminal has one or more air flow paths whose tops and bottoms are open.

7. The board to board connector of claim 1, wherein an end portion of the first protruding part of the support and an end portion of the second protruding part of the terminal are horizontally bent, respectively.

8. The board to board connector of claim 7, wherein the first protruding part has a first protrusion formed on the end portion thereof, and the second protruding part has a second protrusion formed on the end portion thereof.

9. The board to board connector of claim 1, wherein the body of the terminal is formed in a rectangular shape.

10. The board to board connector of claim 5, further comprising an O-ring disposed on the outer circumference of the first protruding part of the support at the top of the outer insulating part.

* * * * *